US007077283B2

(12) United States Patent
Yang et al.

(10) Patent No.: US 7,077,283 B2
(45) Date of Patent: Jul. 18, 2006

(54) TRASH CAN ASSEMBLY

(75) Inventors: Frank Yang, Palos Verdes Peninsula, CA (US); Joseph Sandor, Santa Ana Heights, CA (US)

(73) Assignee: Simplehuman LLC, Los Angeles, CA (US)

( * ) Notice: Subject to any disclaimer, the term of this patent is extended or adjusted under 35 U.S.C. 154(b) by 0 days.

(21) Appl. No.: 10/614,557

(22) Filed: Jul. 7, 2003

(65) Prior Publication Data

US 2005/0006536 A1 Jan. 13, 2005

(51) Int. Cl.
*B65D 43/26* (2006.01)

(52) U.S. Cl. ..... 220/262; 220/908.1

(58) Field of Classification Search ..... 248/95, 248/97, 99, 907; 220/908, 908.1, 262, 263, 220/264

See application file for complete search history.

(56) References Cited

U.S. PATENT DOCUMENTS 2,946,474 A * 7/1960 Knapp ..... 220/23.87
3,762,599 A * 10/1973 Bourgeois ..... 141/391
4,445,619 A * 5/1984 Kubic et al. ..... 220/263
4,972,966 A * 11/1990 Craft, Jr. ..... 220/264
5,125,526 A * 6/1992 Sumanis ..... 220/263
5,390,818 A * 2/1995 LaBuda ..... 220/676
5,598,942 A * 2/1997 Cowie ..... 220/495.08
6,010,024 A * 1/2000 Wang ..... 220/23.87
6,102,343 A * 8/2000 Grimesey et al. ..... 248/95
6,176,455 B1 * 1/2001 Ma ..... 248/101
6,296,138 B1 * 10/2001 Hannah et al. ..... 220/495.08
6,364,147 B1 * 4/2002 Meinzinger et al. ... 220/495.06
6,808,081 B1 * 10/2004 Citro ..... 220/772
2002/0079315 A1 * 6/2002 Yang

FOREIGN PATENT DOCUMENTS

JP 2002274601 A * 9/2002
JP 2003112806 A * 4/2004

* cited by examiner

*Primary Examiner*—A. Joseph Wujciak, III
(74) *Attorney, Agent, or Firm*—Raymond Sun

(57) ABSTRACT

A trash can assembly has a shell, a liner fitted inside the shell, a lid fitted over the top end of the shell, a foot pedal positioned adjacent the bottom end of the shell, a link assembly coupling the foot pedal and the lid, and a support block provided adjacent the bottom end of the shell for supporting the liner in a raised position with respect to the shell. In use, the user can fit a trash bag inside the liner, and then seat the liner inside the shell. To replace the trash bag, the user can raise the liner with respect to the interior of the shell, and support the liner on the support block in a raised position with respect to the shell when removing the trash bag.

8 Claims, 5 Drawing Sheets

TRASH CAN ASSEMBLY

BACKGROUND OF THE INVENTION

1. Field of the Invention

The present invention relates to household items, and in particular, to a trash can assembly that allows for convenient and sanitary replacement of a trash bag from an internal liner.

2. Description of the Prior Art

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid.

Conventional trash cans have been improved over the years to make them more user-friendly, sanitary, and hygienic. For example, many trash cans are now provided with a foot pedal positioned adjacent the base of the trash can so that a user can step on the foot pedal to open the lid of the trash can, thereby freeing up the user's hands to toss trash, or to change the plastic liner or bag that is used to line the trash can. Other trash cans have even provided an internal metal or plastic liner that fits inside the trash can, and which can be removed to be washed. However, these conventional trash cans still suffer from a number of drawbacks.

A number of these drawbacks are associated with the internal liner. In conventional trash cans, a trash bag is fitted over the internal liner, and the user typically needs to raise the liner from the interior of the trash can to remove the trash bag. When the user raises the liner from the trash can, the user may need to grip portions of the trash bag on the interior of the liner, so that the user's fingers may come into contact with dirt, germs or trash items. In addition, the user often needs to remove the entire internal liner to replace the trash bag because there is no mechanism for maintaining the liner in a raised position with respect to the trash can when the user is replacing the trash bag. Unfortunately, the removal of the internal liner is not sanitary since this might result in the spillage or spread of waste material.

Thus, there remains a need for a trash can that facilitates the convenient and sanitary replacement of a trash bag from an internal liner.

SUMMARY OF THE DISCLOSURE

It is an object of the present invention to provide a trash can assembly that allows the user to remove an internal liner in a sanitary manner.

It is another object of the present invention to provide a trash can assembly that facilitates the convenient and sanitary replacement of a trash bag from an internal liner.

In order to accomplish the objects of the present invention, there is provided a trash can assembly that has a shell, a liner fitted inside the shell, a lid fitted over the top end of the shell, a foot pedal positioned adjacent the bottom end of the shell, a link assembly coupling the foot pedal and the lid, and a support block provided adjacent the bottom end of the shell for supporting the liner in a raised position with respect to the shell.

In use, the user can fit a trash bag inside the liner, and then seat the liner inside the shell. To replace the trash bag, the user can raise the liner with respect to the interior of the shell, and support the liner on the support block in a raised position with respect to the shell while removing the trash bag.

DETAILED DESCRIPTION OF THE PREFERRED EMBODIMENTS

Figure 1:
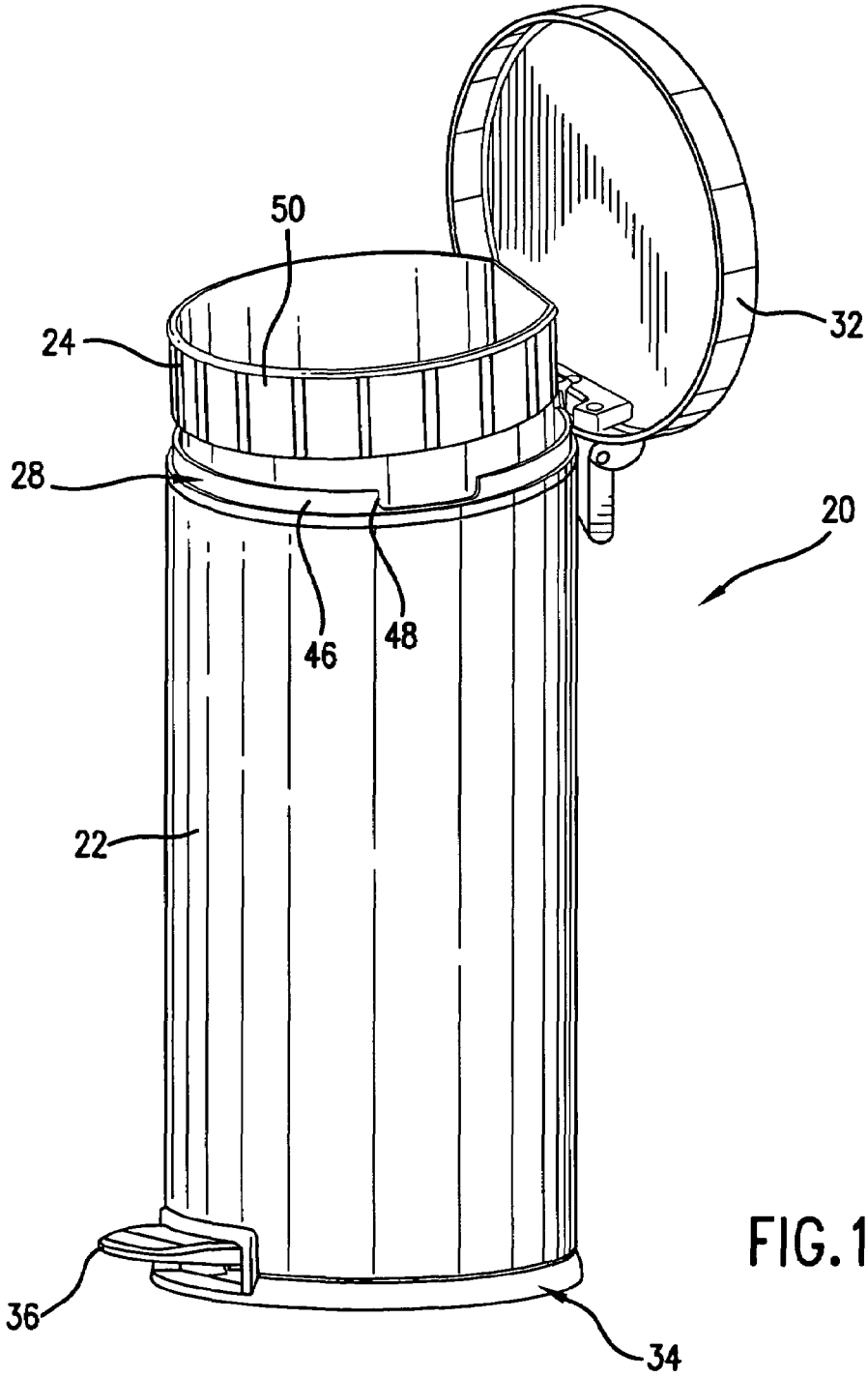
FIG. 1 is a front perspective view of a trash can assembly according to one embodiment of the present invention shown with an internal liner partially raised from within the shell of the trash can assembly.
Figure 2:
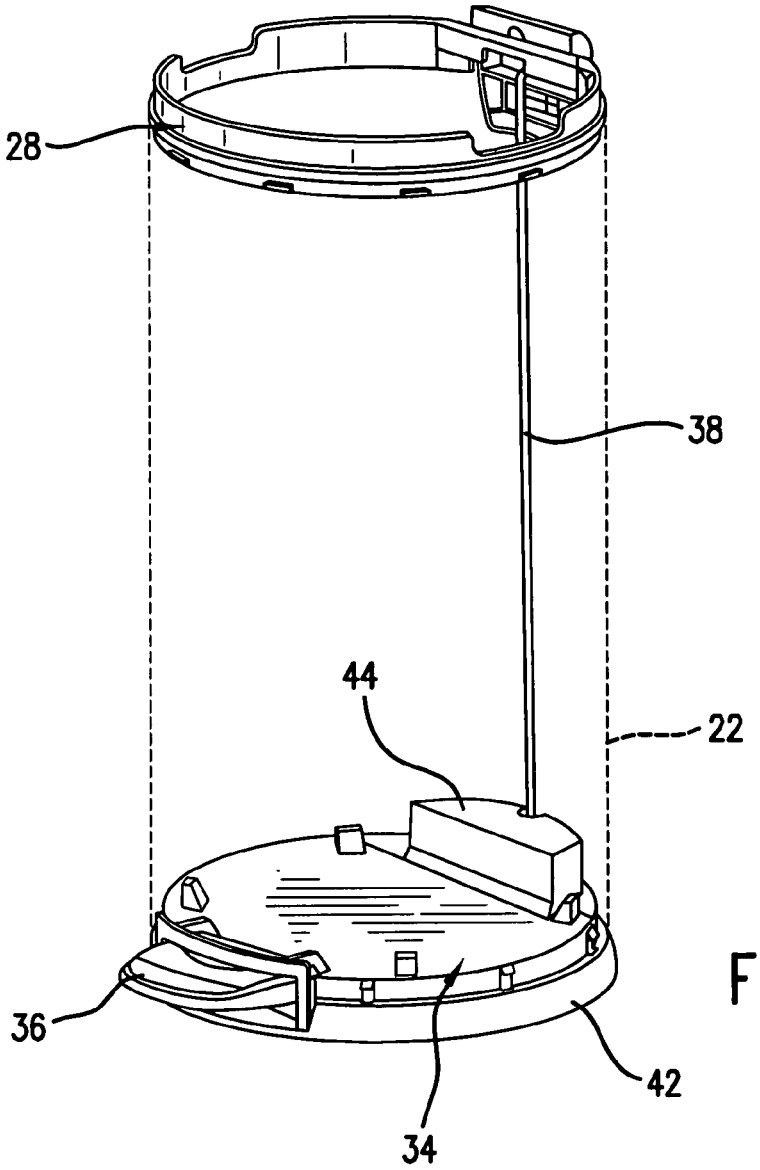
FIG. 2 is a perspective skeletal view of certain internal components of the trash can assembly of FIG. 1.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

FIGS. 1–5 illustrate one embodiment of a trash can assembly 20 according to the present invention. The assembly 20 has a shell 22 and an internal liner 24 that is adapted to be retained inside the shell 22. The shell 22 can be made from either plastic or metal. The liner 24 is essentially a container, and can also be made from either plastic or metal. The shell 22 is an enclosing wall which can have any desired shape, including oval, triangular, rectangular, square or circular (among others). The liner 24 can have the same shape as the shell 22. An upper support frame 28 can be secured to the opened top of the shell 22, and can be provided in a separate material (e.g., plastic if the shell 22 is metal) from the shell 22.

A lid 32 is hingedly connected to the upper support frame 28 using hinged connections that are well-known in the art, and will not be described in greater detail herein. As one non-limiting example, the lid 32 can be hingedly connected to the shell 22 in the manner that is described in U.S. Publication No. US-2002-0079315-A1, published on Jun. 27, 2002 and entitled "Trash Can Assembly With Toe-Kick Recess", whose entire disclosure is incorporated by this reference as though set forth fully herein. The shell 22 and its lid 32 can be made of a solid and stable material, such as a metal. The shell 22 has a base 34, and a foot pedal 36 is pivotably secured to the base 34.

Figure 3:
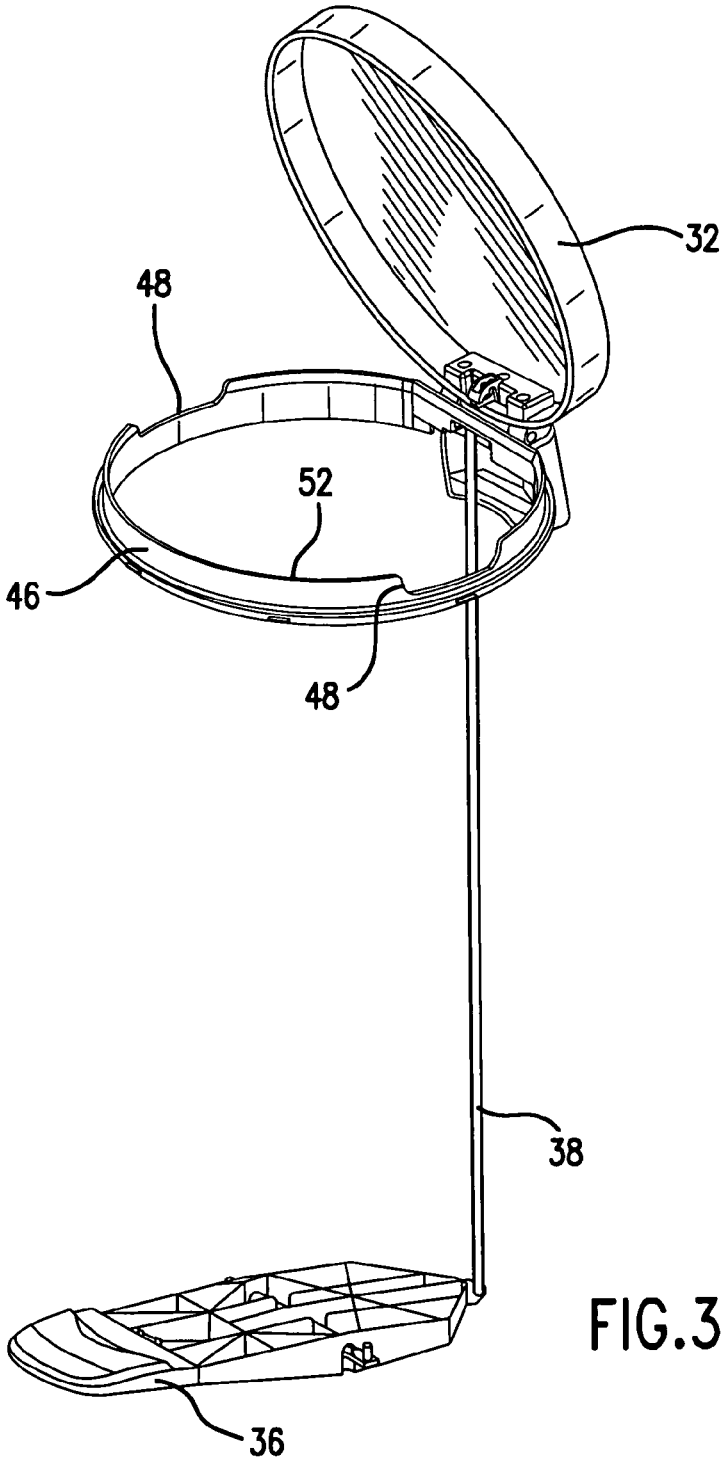
FIG. 3 is a perspective skeletal view of the link assembly that couples the foot pedal and lid of the trash can assembly of FIG. 1.

Referring to FIG. 3, a link assembly 38 extends from the foot pedal 36 along the base 34 and then upwardly along the shell 22 to the upper support frame 28 and the lid 32. The link assembly 38 operates to translate an up-down pivot motion of the pedal 36 to an up-down pivot motion for the lid 32. The construction and operation of link assemblies are well-known in the art, and will not be described in greater detail herein. As one non-limiting example, the link assembly 38, foot pedal 36 and lid 32 can be constructed in accordance with that which is described in U.S. Publication No. US-2002-0079315-A1, published on Jun. 27, 2002 and entitled "Trash Can Assembly With Toe-Kick Recess".

The base 34 of the shell 22 defines a generally annular and curved skirt or flange portion 42. In one embodiment of the present invention, the skirt 42 is formed in one plastic piece. The shell 22 can be attached to the top of the skirt 42 of the base. 34 by a groove snap-on, glue, welding, screws, and similar attachment mechanisms. A support block 44 is provided on the rear part of the base 34, adjacent the link assembly 38. The support block 44 can be embodied in the form of a plastic or metal block having a height that is, in one non-limiting embodiment, at least one inch, and through which the link assembly 38 can extend.

The upper support frame 28 has an annular recessed wall 46. One or more cut-outs or grooves 48 are spaced-apart about the wall 46. The grooves 48 allow the user to insert his or her fingers through the grooves 48 under the upper lip 50 of the internal liner 24 to lift the internal liner 24 from the interior of the shell 24 when the lid 32 is opened. This provides a convenient way for the user to remove the internal liner 24 from the shell 22, without requiring the user to place his or her hands inside the internal liner 24 to grip the internal liner 24.

Figure 4:
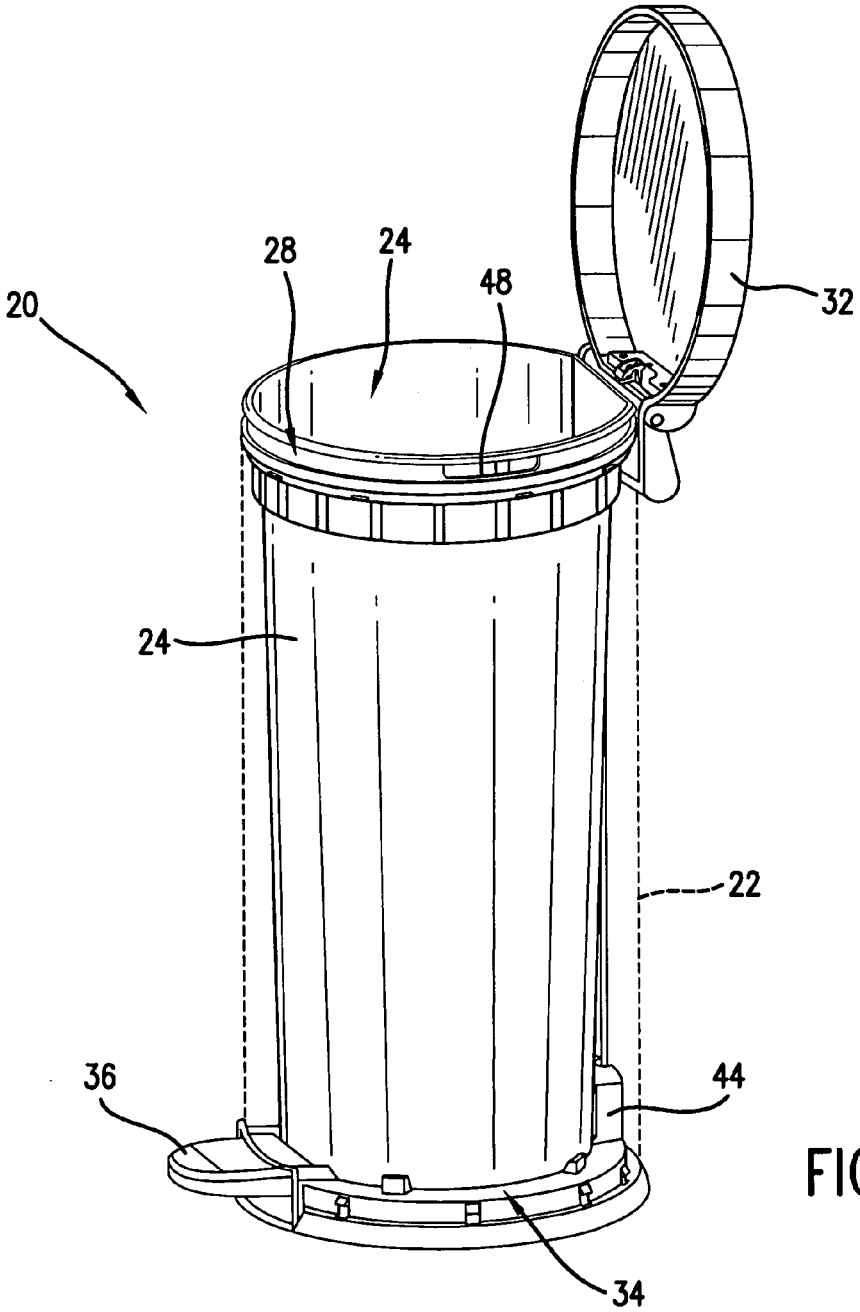
FIG. 4 is a perspective view of the trash can assembly of FIG. 1 illustrating the internal liner fitted completely inside the shell.

FIG. 4 illustrates the trash can assembly 20 with the lid 32 pivoted to the open position, and with the internal liner 24 completely seated inside the interior of the shell 22. In this position, the lip 50 of the liner 24 is preferably aligned with the top annular edge 52 of the annular wall 46. As best seen in FIG. 4, a portion of the lip 50 of the liner 24 can be accessed via any of the grooves 48 in the annular wall 46. Thus, the user can raise the liner 24 by gripping the lip 50 via any groove 48.

Figure 5:
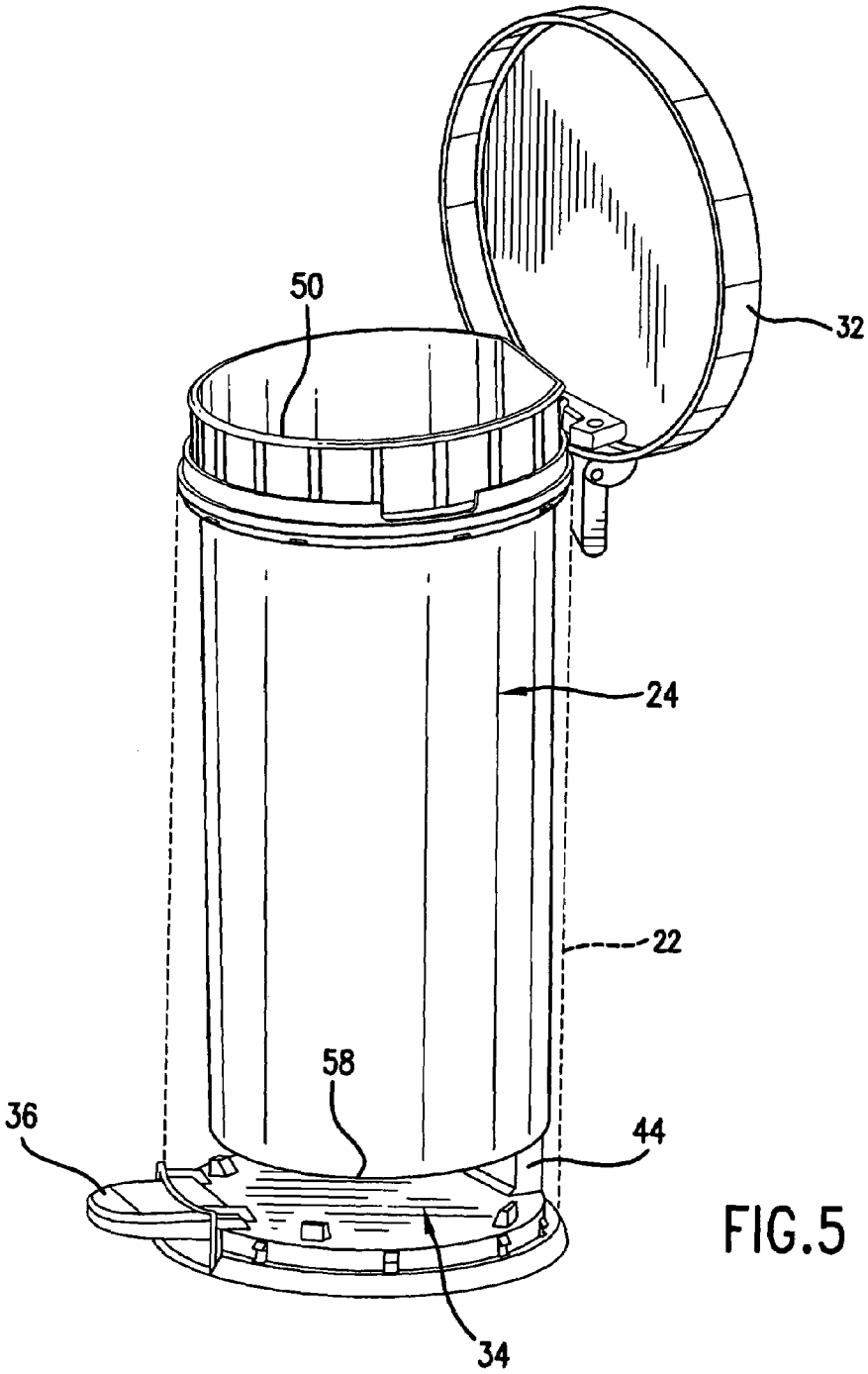
FIG. 5 is a perspective view of the trash can assembly of FIG. 1 illustrating the internal liner partially raised from within the shell.

Once the liner 24 has been raised, the user can tilt the bottom 58 of the liner 24 towards the link assembly 38 (i.e., towards the rear of the shell 22) so that the bottom 58 of the liner 24 is seated on top of the support block 44, as shown in FIGS. 1 and 5. Thus, the support block 44 functions to maintain the liner 24 at a position where the liner 24 is slightly raised with respect to the shell 22, so as to provide sufficient clearance for the user to grip the trash bag. The user can then remove the existing trash bag, and replace it with a new trash bag, all while the liner 24 remains inside the shell 22. When the user has completed the replacement of the trash bag, the user can lift the internal liner 24 slightly and then tilt the bottom 58 of the liner 24 away from the link assembly 38 (i.e., towards the front of the shell 22) so that the bottom 58 of the liner 24 can be fitted via gravity on the top surface of the base 34, as shown in FIG. 4.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A trash can assembly, comprising:

a shell having a top end and a bottom end;

a rigid liner defining a container body having a bottom and an enclosing side wall, the liner fitted inside the shell;

a lid fitted over the top end of the shell; and a support block provided adjacent the bottom end of the shell;

wherein the liner is adapted to be positioned in a first position with the support block located side-by-side with the side wall of the container body, and is adapted to be positioned in a second raised position with the bottom of the container body seated on top of the support block; and wherein the container body is at a first vertical level in the first position, and is at a second vertical level in the second raised position, with the second vertical level being higher than the first vertical level.

2. The assembly of claim 1, wherein the enclosing side wall has an upper lip, and wherein the assembly further includes an annular wall provided at the top end of the shell, the annular wall having a groove which exposes a portion of the upper lip.

3. The assembly of claim 1, further including a base provided at the bottom end of the shell, with the support block positioned on the base, and with the bottom of the container body seated on the base when in the first position.

4. The assembly of claim 3, wherein the base defines a skirt surrounding the bottom end of the shell.

5. The assembly of claim 1, further including a foot pedal positioned adjacent the bottom end of the shell.

6. The assembly of claim 5, further including a link assembly coupling the foot pedal and the lid.

7. The assembly of claim 1, wherein the entire support block is positioned below the bottom of the container body in the second raised position.

8. The assembly of claim 1, further including a base provided at the bottom end of the shell, the base having a height, and wherein the support block has a height which is greater than the height of the base.

* * * * *